US009046066B2

(12) United States Patent
Del Frate et al.

(10) Patent No.: US 9,046,066 B2
(45) Date of Patent: Jun. 2, 2015

(54) VALVE ASSEMBLY FOR AN INJECTION VALVE, INJECTION VALVE AND METHOD FOR ASSEMBLING A VALVE ASSEMBLY OF AN INJECTION VALVE

(75) Inventors: Licia Del Frate, Lucca (IT); Ivano Izzo, Pisa (IT); Luca Matteucci, Pisa (IT); Marco Omeri, Viareggio (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 408 days.

(21) Appl. No.: 13/635,625

(22) PCT Filed: Mar. 10, 2011

(86) PCT No.: PCT/EP2011/053627

§ 371 (c)(1),
(2), (4) Date: Apr. 17, 2013

(87) PCT Pub. No.: WO2011/113746

PCT Pub. Date: Sep. 22, 2011

(65) Prior Publication Data

US 2013/0193239 A1 Aug. 1, 2013

(30) Foreign Application Priority Data

Mar. 17, 2010 (EP) ..... 10002813

(51) Int. Cl.
*F02M 51/06* (2006.01)
*F02M 61/08* (2006.01)
(Continued)

(52) U.S. Cl.
CPC ..... *F02M 51/0625* (2013.01); *F02M 51/0671* (2013.01); *F02M 61/08* (2013.01);
(Continued)

(58) Field of Classification Search
CPC ..... F02M 51/00; F02M 51/005; F02M 51/02; F02M 51/06; F02M 51/0603; F02M 51/061; F02M 51/0607; F02M 51/0625; F02M 51/0635; F02M 51/0642; F02M 51/0653
USPC ..... 239/533.1–533.12, 584, 585.1, 585.3, 239/585.4, 585.5; 123/299, 446, 447, 467, 123/468
See application file for complete search history.

(56) References Cited

U.S. PATENT DOCUMENTS 2,559,364 A * 7/1951 Mashinter ..... 239/90
6,213,414 B1 * 4/2001 Stier et al. ..... 239/584
(Continued)

FOREIGN PATENT DOCUMENTS

DE 102007008901 A1 8/2008 ..... F02M 51/06
EP 1046809 A2 10/2000 ..... F02M 51/06
(Continued)

OTHER PUBLICATIONS

European Search Report, Application No. 10002813.3, 6 pages, Aug. 2, 2010.
(Continued)

*Primary Examiner* — Justin Jonaitis
(74) *Attorney, Agent, or Firm* — King & Spalding, L.L.P.

(57) ABSTRACT

A valve assembly for an injection valve and a method for assembling a valve assembly are provided. The valve assembly includes a valve body with a central longitudinal axis and having a cavity with a fluid inlet portion and a fluid outlet portion, an end portion being arranged at an axial end facing away from the fluid outlet portion, and a seat being arranged at an axial end of the valve body facing the fluid outlet portion. A valve needle is axially movable in the cavity and prevents a fluid flow through the fluid outlet portion in a closing position and releases the fluid flow through the flu-id outlet portion in further positions. The valve needle has an axial end facing away from the fluid outlet portion and facing the end portion, and a seat part resting on the seat of the valve body in the closing position. A contact area between the seat part and the seat of the valve body has a first outer diameter. The valve assembly includes an electro-magnetic actuator unit being designed to actuate the valve needle. A bellow arrangement includes a bellow and an end portion, the bellow is fixedly coupled to the end portion in a coupling area. The coupling area has a second outer diameter. The first outer diameter is equal to the second outer diameter.

5 Claims, 4 Drawing Sheets

(51) Int. Cl.

| | |
|---|---|
| ***F02M 61/16*** | (2006.01) |
| ***F02M 61/20*** | (2006.01) |
| ***F02M 63/00*** | (2006.01) |
| ***F02M 65/00*** | (2006.01) |
| ***F02M 61/12*** | (2006.01) |

(52) U.S. Cl.
CPC ..... *F02M 61/168* (2013.01); *F02M 61/205* (2013.01); *F02M 63/0057* (2013.01); *F02M 65/005* (2013.01); *F02M 61/12* (2013.01)

(56) References Cited

U.S. PATENT DOCUMENTS

| | | | | |
|---|---|---|---|---|
| 6,311,950 | B1 * | 11/2001 | Kappel et al. | 251/129.06 |
| 7,044,407 | B2 * | 5/2006 | Fischer et al. | 239/533.7 |
| 8,480,014 | B2 | 7/2013 | Gruendl et al. | 239/585.3 |
| 2005/0017096 | A1 * | 1/2005 | Bachmaier et al. | 239/584 |

FOREIGN PATENT DOCUMENTS

| | | | | |
|---|---|---|---|---|
| EP | 1731754 | A1 | 12/2006 | F02M 61/16 |
| EP | 2123899 | A1 | 11/2009 | F02M 51/06 |
| WO | 00/43666 | A1 | 7/2000 | F02M 51/06 |
| WO | 02/36959 | A2 | 5/2002 | F02M 51/06 |
| WO | 2011/113746 | A1 | 9/2011 | F02M 51/06 |

OTHER PUBLICATIONS

International Search Report and Written Opinion, Application No. PCT/EP2011/053627, 11 pages, Apr. 4, 2011.

Chinese Office Action, Application No. 201180014227.6, 12 pages, Feb. 8, 2014.

* cited by examiner

VALVE ASSEMBLY FOR AN INJECTION VALVE, INJECTION VALVE AND METHOD FOR ASSEMBLING A VALVE ASSEMBLY OF AN INJECTION VALVE

CROSS-REFERENCE TO RELATED APPLICATIONS

This application is a U.S. National Stage Application of International Application No. PCT/EP2011/053627 filed Mar. 10, 2011, which designates the United States of America, and claims priority to EP Application No. 10002813.3 filed Mar. 17, 2010, the contents of which are hereby incorporated by reference in their entirety.

TECHNICAL FIELD

This disclosure relates to a valve assembly for an injection valve, to an injection valve and to a method for assembling a valve assembly of an injection valve.

BACKGROUND

Injection valves are in wide spread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter and also various elements of the injection valve being responsible for the way the fluid is dosed may vary in a wide range. In addition to that, injection valves may accommodate an actuator for actuating a needle of the injection valve, which may, for example, be an electromagnetic actuator or piezo electric actuator.

In order to enhance the combustion process in view of the creation of unwanted emissions, the respective injection valve may be suited to dose fluids under very high pressures. The pressures may be in case of a gasoline engine, for example, in the range of up to 200 bar and in the case of diesel engines in the range of up to 2000 bar.

SUMMARY

In one embodiment, a valve assembly for an injection valve includes a valve body, a valve needle, an electro-magnetic actuator unit, a ring element, an armature support spring, and a bellow arrangement. The valve body includes a central longitudinal axis, a cavity with a fluid inlet portion and a fluid outlet portion, an end portion being arranged at an axial end facing away from the fluid outlet portion, a seat being arranged at an axial end of the valve body facing the fluid outlet portion, and a valve cartridge and a housing. The valve needle is axially movable in the cavity, and prevents a fluid flow through the fluid outlet portion in a closing position and releasing the fluid flow through the fluid outlet portion in further positions. The valve needle comprises an axial needle end facing away from the fluid outlet portion and facing the end portion of the valve body, and a seat part resting on the seat of the valve body in the closing position, a contact area between the seat part and the seat of the valve body having a first outer diameter. The electro-magnetic actuator unit is designed to actuate the valve needle and comprising an armature. The ring element is arranged in the cavity radially between the cartridge and the housing and axially between the coil and the armature. The armature support spring is arranged in the cavity axially between the ring element and the armature. The bellow arrangement comprises a bellow and an end portion, the bellow being fixedly coupled to the end portion in a coupling area. The bellow is fixedly coupled to the axial end of the valve needle, and the end portion of the bellow arrangement is fixedly coupled to the end portion of the valve body, the bellow arrangement is sealingly coupling the valve body with the valve needle, the coupling area having a second outer diameter, with the first outer diameter being equal to the second outer diameter.

In another embodiment, an injection valve includes a valve assembly as described above.

In another embodiment, a method for assembling a valve assembly of an injection valve comprises the following steps: providing a valve cartridge and a valve needle, the valve cartridge comprising a cavity, arranging the valve needle in the cavity of the valve cartridge, providing an armature and coupling the armature to the valve needle, providing a reference electro-magnetic actuator and coupling the reference electro-magnetic actuator to the valve cartridge, activating the reference electro-magnetic actuator to cause an axial movement of the valve needle and determining a lift of the axial movement of the valve needle, fixedly coupling the armature to the valve needle, and decoupling the reference electro-magnetic actuator from the valve cartridge.

In a further embodiment, after the reference electro-magnetic actuator is decoupled from the valve cartridge, a housing containing a coil is fixedly coupled to the valve cartridge, wherein the housing and the coil are part of an electro-magnetic actuator unit. In a further embodiment, after the valve cartridge is provided, a ring element is fixedly coupled to the valve cartridge. In a further embodiment, after the valve needle is arranged in the cavity of the valve cartridge, an armature support spring is coupled to the valve needle.

In another embodiment, a method for assembling a valve assembly of an injection valve comprises the following steps: providing a valve cartridge and a valve needle, the valve cartridge comprising a cavity, fixedly coupling a housing containing a coil to the valve cartridge, wherein the housing and the coil are part of an electro-magnetic actuator unit, arranging the valve needle in the cavity of the valve cartridge, providing an armature and an armature support spring and coupling the armature and the armature support spring to the valve needle, activating the electro-magnetic actuator unit to cause an axial movement of the valve needle and determining a lift of the axial movement of the valve needle, fixedly coupling the armature to the valve needle, and fixedly coupling a bellow arrangement to the valve needle.

BRIEF DESCRIPTION OF THE DRAWINGS

Example embodiments will be explained in more detail below with reference to figures, in which.

DETAILED DESCRIPTION

Figure 1:
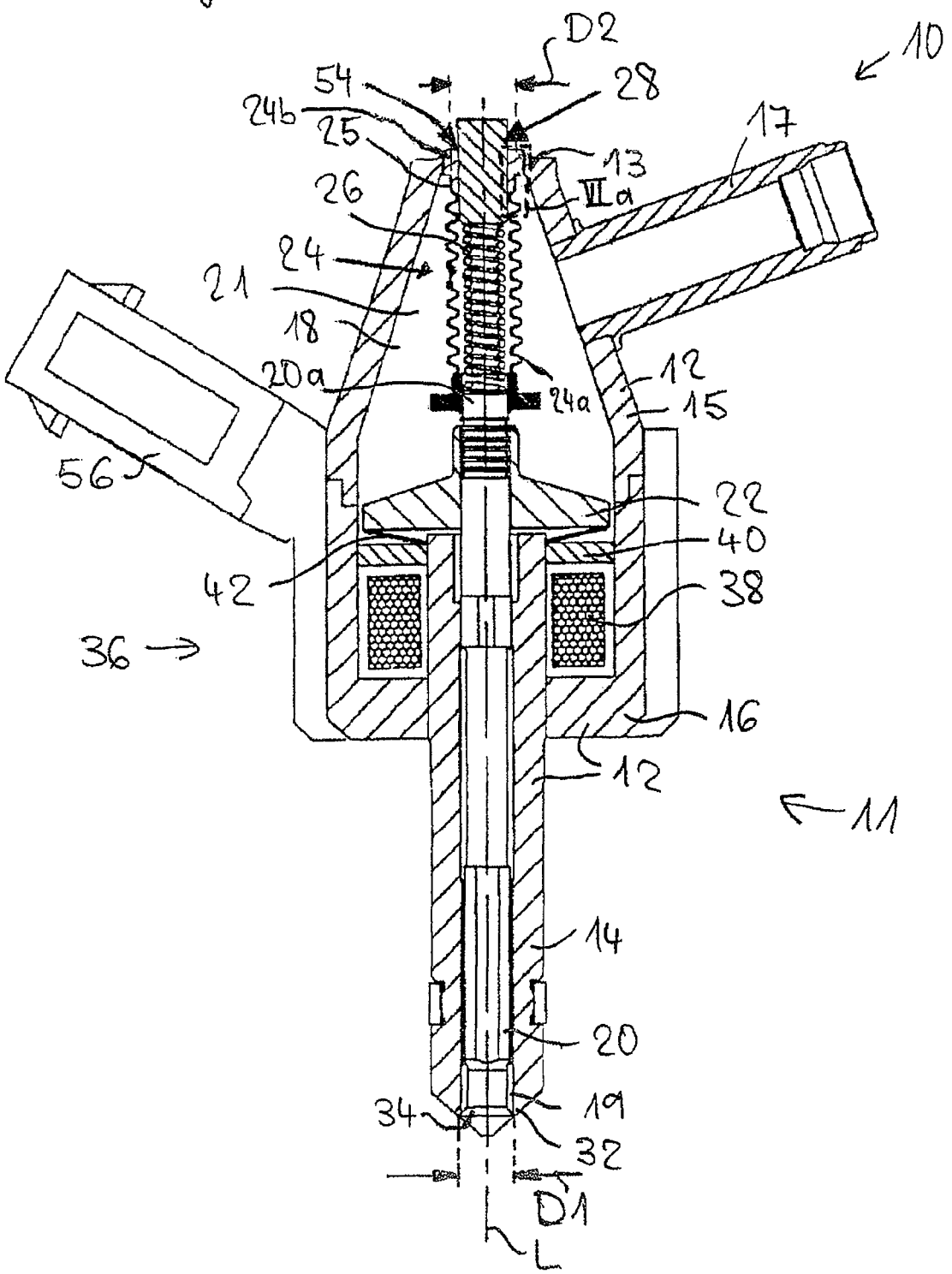
FIGS. 1 and 1*a* illustrate an injection valve with a valve assembly in a longitudinal section view.

Some embodiments provide a valve assembly of an injection valve, an injection valve and a method for assembling a valve assembly of an injection valve which facilitate a reliable and precise function of the injection valve.

For example, some embodiments provide a valve assembly for an injection valve, comprising a valve body including a central longitudinal axis. The valve body comprises a cavity with a fluid inlet portion and a fluid outlet portion, an end portion being arranged at an axial end facing away from the fluid outlet portion, and a needle seat being arranged at an axial end facing the fluid outlet portion. The valve assembly comprises a valve needle axially movable in the cavity, the valve needle preventing a fluid flow through the fluid outlet portion in a closing position and releasing the fluid flow through the fluid outlet portion in further positions. The valve needle comprises an axial needle end facing away from the fluid outlet portion and facing the end portion of the valve body, and a seat part resting on the needle seat of the valve body in the closing position, a contact area between the seat part and the seat of the valve body having a first outer diameter. The valve assembly comprises an electro-magnetic actuator unit being designed to actuate the valve needle. A bellow arrangement comprises a bellow and an end portion. The bellow is fixedly coupled to the end portion of the bellow arrangement in a coupling area. The bellow is fixedly coupled to the axial end of the valve needle, and the end portion of the bellow arrangement is fixedly coupled to the end portion of the valve body in a coupling area. The bellow arrangement is sealingly coupling the valve body with the valve needle, the coupling area having a second outer diameter. The first outer diameter is equal to the second outer diameter.

This may reduce the overall cost of the valve assembly due to the low costs of the components of the electro-magnetic actuator and due to low scrap costs. In particular, no thermal compensator is necessary. Additionally, due to the equal diameters the hydraulic forces acting on the valve needle and acting on the bellow are balanced independent of the fluid pressure. Consequently, a high stability of the jet of the injected fluid is possible.

Other embodiments provide an injection valve including a valve assembly as described above.

Other embodiments provide a method for assembling a valve assembly of an injection valve. The method comprises the following steps: providing a valve cartridge and a valve needle, the valve cartridge comprising a cavity, arranging the valve needle in the cavity of the valve cartridge, providing an armature and coupling the armature to the valve needle, providing a reference electromagnetic actuator and coupling the reference electro-magnetic actuator to the valve cartridge, activating the reference electro-magnetic actuator to cause an axial movement of the valve needle and determining a lift of the axial movement of the valve needle, fixedly coupling the armature to the valve needle, and decoupling the reference electro-magnetic actuator from the valve cartridge. The reference electro-magnetic actuator is an actuator which may be used to determine the lifts of the valve needles of a sequence of valve assemblies in a reproducible manner. The lift of the axial movement of the valve needle is an important parameter for an amount of fluid being injected by the valve assembly of the injection valve. Thus, the lift of the axial movement of the valve needle can be determined without using the electro-magnetic actuator unit of the valve assembly. Therefore, scrap costs in view of the electro-magnetic actuator unit of the valve assembly can be kept low.

In one embodiment, after the reference electro-magnetic actuator is decoupled from the valve cartridge a housing containing a coil is fixedly coupled to the valve cartridge. The housing and the coil are part of the electro-magnetic actuator unit. Thus, the housing and the coil of the electro-magnetic actuator unit can be coupled to the valve body in the end of the assembly process. Consequently, low scrap costs in view of electro-magnetic actuator components during the assembly process of the valve assembly are possible.

An injection valve 10 is in particular suitable for dosing fuel to an internal combustion engine which is of an outward opening type and comprises a valve assembly 11. The valve assembly 11 comprises a valve body 12 with a central longitudinal axis L. The valve body 12 has an end portion 13 which is arranged at an axial end of the valve body 12. The valve body 12 has a valve cartridge 14, a valve cap 15 and a housing 16 which is partially arranged around the valve cartridge 14. The valve assembly 11 comprises an inlet tube 17 which is fixedly coupled to the valve body 12. In particular, the inlet tube 17 is fixedly coupled to the valve cap 15.

The valve body 12 has a cavity 18. On one of the free ends of the cavity 18, a fluid outlet portion 19 is formed which is closed or open depending on the axial position of a valve needle 20. The valve needle 20 is arranged in the cavity 18 and is axially movable in the cavity 18. The valve needle 20 has an axial end 20*a* which faces away from the fluid outlet portion 19 and faces the end portion 13 of the valve body 12.

The injection valve 10 further has a fluid inlet portion 21 which is hydraulically coupled to the cavity 18 and to a not shown fuel connector which is coupled to the inlet tube 17. The cavity 18 takes in an armature 22 which is axially movable in the cavity 18. The armature 22 is fixedly coupled to the valve needle 20. The armature 22 has apertures 23 which extend in axial direction and allow a fluid flow through the armature 22 (FIG. 4*a*).

Between the valve needle 20 and the valve body 12 a bellow arrangement 24 is arranged which has a bellow 24*a* and an end portion 24*b*. The bellow 24*a* of the bellow arrangement 24 is fixedly coupled to the end portion 24*b* of the bellow arrangement 24 in a coupling area 25. The bellow arrangement 24 is sealingly coupling the valve body 12 with the valve needle 20 so that a fluid flow between the cavity 18 and the ambiance can be prevented. A calibration spring 26 is arranged inside the bellow arrangement 24. The calibration spring 26 is mechanically coupled to the axial end 20*a* of the valve needle 20. The valve needle 20 forms a first seat for the calibration spring 26. A piston 28 is partially arranged inside the bellow arrangement 24 and forms a further seat for the calibration spring 26. During the manufacturing process of the injection valve 10 the piston 28 can be axially moved into the bellow arrangement 24 in order to preload the calibration spring 26 in a desired manner. By this the calibration spring 26 exerts a force on the valve needle 20 towards an injection opening 30.

The valve body 12 has a seat 32 which is arranged at an axial end of the valve body 12 facing the fluid outlet portion 19. In a closing position of the valve needle 20 a seat part 34 of the valve needle 20 sealingly rests on the seat 32 by this preventing a fluid flow through the injection opening 30. A contact area between the seat part 34 and the seat 32 of the valve body 12 defines a first outer diameter D1. The coupling area 25 between the end portion 24*b* of the bellow arrangement 24 and the bellow 24*a* has a second outer diameter D2. The first outer diameter D1 is equal to the second outer diameter D2. As the diameters D1, D2 are equal, the valve needle is hydraulically equilibrated for every pressure. Therefore, the dynamic behavior of the injection valve 10 can be independent of the fluid pressure. Consequently, a high stability of the jet of the injected fluid is possible. If the injection valve 10 is used in an internal combustion engine a high stability of the jet of injected fuel allows performing a stratified combustion in a combustion chamber of the combustion engine. A further advantage of the pressure balanced valve is that it has no upper functional limits in terms of operative pressure. Consequently, the only upper limit of operative pressure is related to the valve structural resistance.

The valve assembly 11 comprises an electro-magnetic actuator unit 36. The actuator unit 36 comprises a coil 38, which may be arranged inside the housing 16 and which is over-molded. Furthermore, the actuator unit 36 comprises the armature 22. Parts of the valve body 12, the housing 16 and the armature 22 are forming an electromagnetic circuit. The electro-magnetic actuator unit 36 can be manufactured with low costs. Furthermore, the electro-magnetic actuator unit 36 does not need a thermal compensator as the components of the electro-magnetic actuator unit 36 may have similar thermal expansion coefficients. A ring element 40 is arranged in the cavity 18 radially between the cartridge 14 and the housing 16 and axially between the coil 38 and the armature 22. The ring element 40 is fixedly and sealingly coupled to the cartridge 14 and the housing 16. The ring element 40 may comprise a non-magnetic material. An armature support spring 42 is arranged in the cavity 18 axially between the ring element 40 and the armature 22. The armature support spring 42 may be a belleville spring. The armature support spring 42 has apertures which allow a fluid flow through the armature support spring 42 in axial direction. The armature support spring 42 is supported by the ring element 40.

Figure 2:
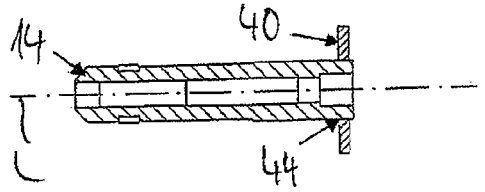
FIG. 2 illustrates parts of the valve assembly in a longitudinal section view.
Figure 3:
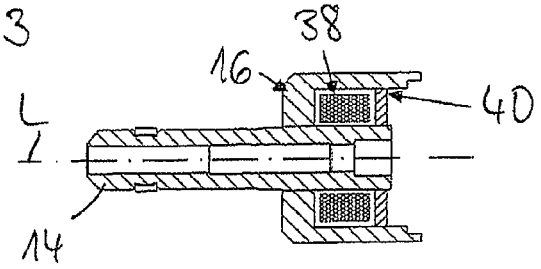
FIG. 3 illustrates parts of the valve assembly in a longitudinal section view.
Figure 4:
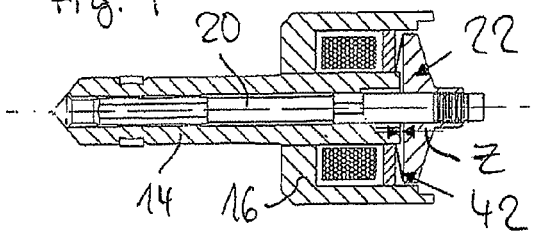
FIGS. 4 and 4*a* illustrate parts of the valve assembly.
Figure 4A:
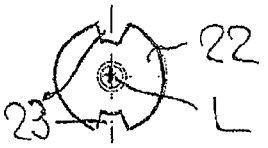
Figure 5:
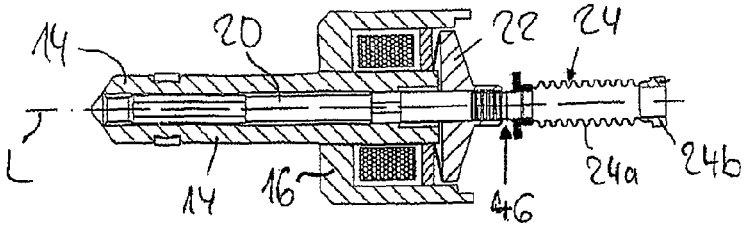
FIG. 5 illustrates parts of the valve assembly in a longitudinal section view.
Figure 6:
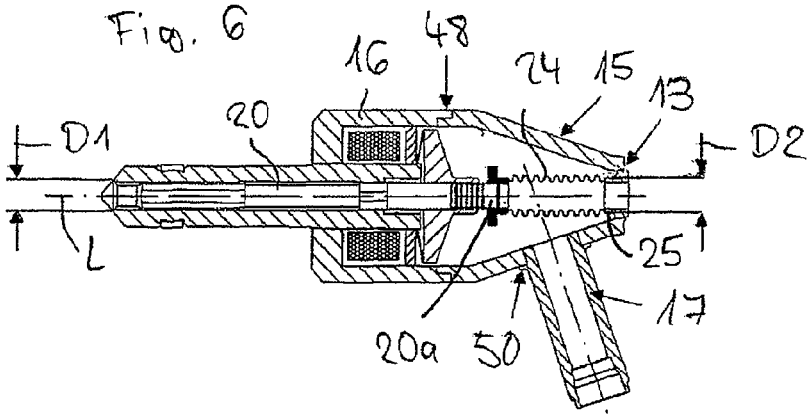
FIGS. 6 and 6*a* illustrate parts of the valve assembly in a longitudinal section view.
Figure 6A:
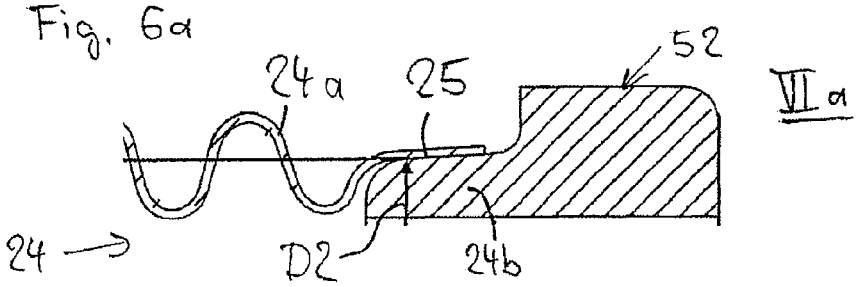
Figure 7:
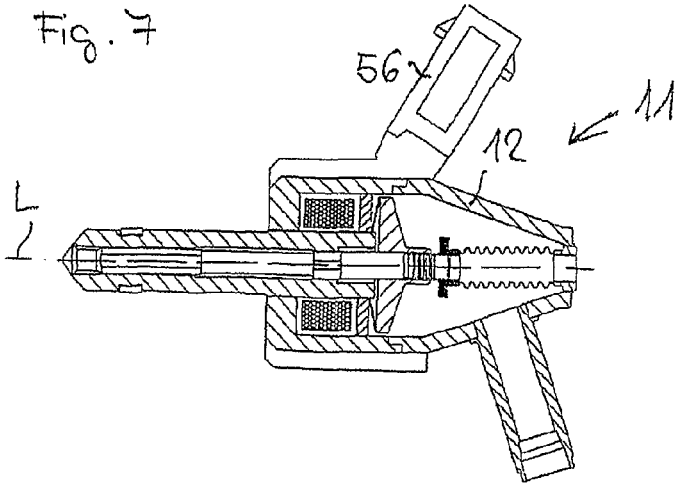
FIG. 7 illustrates parts of the valve assembly in a longitudinal section view.

In the following, a method for assembling the valve assembly 11 according to the FIGS. 2 to 7 is described in detail: The valve cartridge 14 and the ring element 40 are provided. The ring element 40 is welded to the valve cartridge 14 along a welding line 44 (FIG. 2). Subsequently, the housing 16 and the coil 38 are provided and are fixedly coupled to the cartridge 14 and the ring element 40. The housing 16 may be soldered to the ring element 40 to obtain a sealed coupling (FIG. 3). In the following the valve needle 20 is provided and inserted into the cartridge 14, and the armature support spring 42 and the armature 22 are coupled to the ring element 40. Subsequently, the coil 38 is electrically activated and a lift Z of the valve needle 20 is determined. The armature 22 is fixedly coupled to the valve needle 20, e.g., by crimping (FIG. 4). In the following, the bellow arrangement 24 is fixedly coupled to the axial end 20*a* of valve needle 20, e.g., by press-fitting and soldering along a circumference line 46 (FIG. 5). Subsequently, the valve cap 15 is soldered to the housing 16 along a circumference line 48 and is fixedly coupled to the end portion 24*b* of the bellow arrangement 24 along the circumference line 52. The inlet tube 17 is fixedly coupled to the valve cap 15 along a circumference line 50 (FIG. 6, 6*a*). According to FIG. 7, subsequently, the valve assembly 11 is overmolded and an electric connector 56 is fixedly coupled to the valve assembly 11. Finally, a calibration process is carried out, by compressing the calibration spring 26 by the piston 28 until the desired amount of fuel is injected. After the calibration process, the piston 28 is fixedly coupled to the end portion 24*b* of the bellow arrangement 24, e.g., by soldering along a circumference line 54 (FIG. 1).

Figure 8:
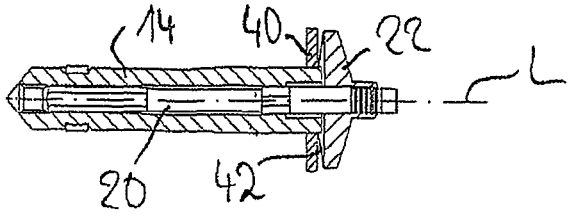
FIG. 8 illustrates parts of the valve assembly in a longitudinal section view.
Figure 9:
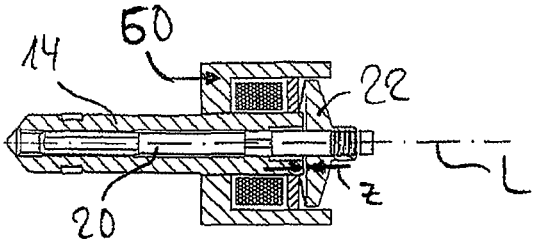
FIG. 9 illustrates parts of the valve assembly in a longitudinal section view.
Figure 10:
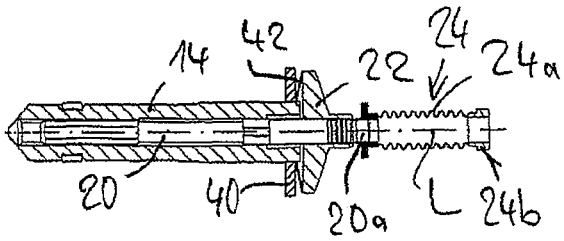
FIG. 10 illustrates parts of the valve assembly in a longitudinal section view.
Figure 11:
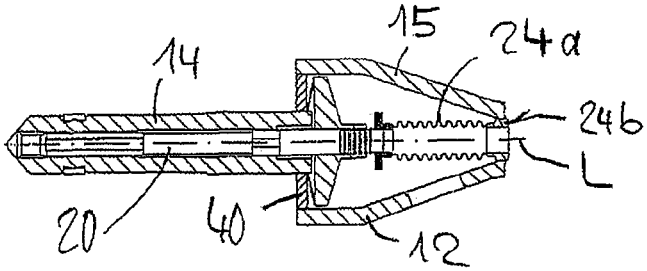
FIG. 11 illustrates parts of the valve assembly in a longitudinal section view.
Figure 12:
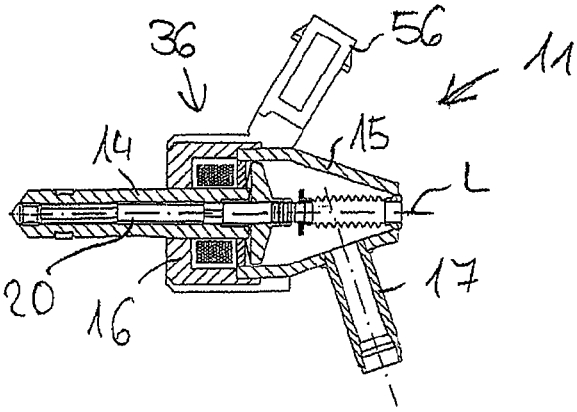
FIG. 12 illustrates parts of the valve assembly in a longitudinal section view.

In the following, a further method of assembling the valve assembly 11 is described in detail (see FIGS. 8 to 12): The valve cartridge 14 and the ring element 40 are provided and fixedly coupled to each other. The valve needle 20 is arranged in the valve cartridge 14, and the armature 22 and the armature support spring 42 are coupled to the valve needle 20 (FIG. 8). In the following, a reference electromagnetic actuator 60 is provided and coupled to the valve cartridge 14 and to the ring element 40 (FIG. 9). The reference electromagnetic actuator 60 has the task to determine the lifts of valve needles of a sequence of valve assemblies in a production process in a reproducible manner. The reference electromagnetic actuator 60 is electrically activated to cause an axial movement of the valve needle 20 and to determine the lift Z of the axial movement of the valve needle 20 (FIG. 9). The reference electromagnetic actuator 60 is decoupled from the cartridge 14 and the bellow arrangement 24 is fixedly coupled to the axial end 20*a* of valve needle 20 (FIG. 10). In the following, the valve cap 15 is fixedly coupled to the ring element 40 and to the end portion 24*a* of the bellow arrangement 24 (FIG. 11). Subsequently, the housing 16 containing the coil 38 is fixedly coupled to the valve cap 15 and the valve cartridge 14. Then, the valve assembly 11 is overmolded and the electric connector 56 is coupled to the valve assembly 11 (FIG. 12). Finally, a calibration process is carried out as described above for the process according to the FIGS. 1 to 7.

Figure 1A:
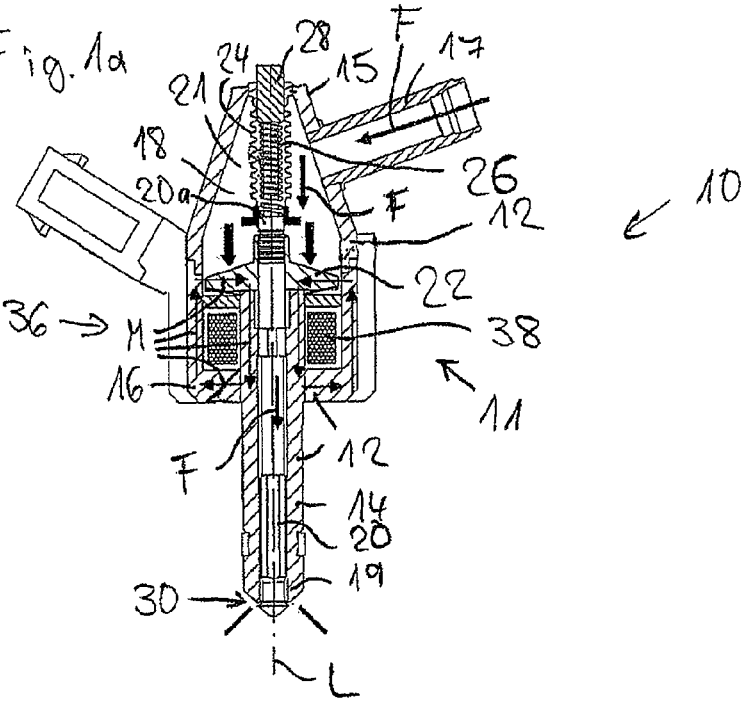

In the following, the function of the injection valve 10 is described according to FIG. 1*a:*

Pressurized fluid is flowing through the inlet tube 17 to the fluid inlet portion 21 inside the valve body 12. The fluid passes the armature 22 and the armature support spring 42. Subsequently, the fluid is flowing in direction to the fluid outlet portion 19 between the cartridge 14 and the valve needle 20 (fluid directions according arrows F). An electrical activation of the coil 38 produces electromagnetic force acting on the armature 22 in direction to the cartridge 14. The electrical activation of the coil 38 causes an electromagnetic flux in the cartridge 14, the housing 16 and the armature 22 (magnetic flux directions according arrows M). As the ring element 40 is of a non-magnetic material the magnetic flux generated by the coil 38 is focused to the armature 22.

Therefore, the armature 22 receives a high force in direction to the cartridge 14, and the armature 22 moves in direction to the cartridge 14 until it comes into contact with the cartridge 14. As the valve needle 20 is fixedly coupled to the armature 22, the valve needle 20 is pushed in an outward direction. Consequently, fluid can flow from the fluid outlet portion 19 through the injection opening 30.

What is claimed is:

1. Valve assembly for an injection valve, comprising:

a valve body including a central longitudinal axis, the valve body comprising:

a cavity with a fluid inlet portion and a fluid outlet portion, an end portion at an axial end facing away from the fluid outlet portion, a seat arranged at an axial end of the valve body facing the fluid outlet portion, and a valve cartridge and a housing, a valve needle axially movable in the cavity, the valve needle preventing a fluid flow through the fluid outlet portion in a closing position and releasing the fluid flow through the fluid outlet portion in further positions, the valve needle comprising:

an axial needle end facing away from the fluid outlet portion and facing the end portion of the valve body, and a seat part resting on the seat of the valve body in the closing position, wherein a contact area between the seat part and the seat of the valve body has a first outer diameter, an electro-magnetic actuator unit configured to actuate the valve needle and comprising an armature and a coil, a ring element arranged in the cavity radially between the cartridge and the housing and axially between the coil and the armature, an armature support spring arranged in the cavity axially between the ring element and the armature, a bellow arrangement comprising a bellow and an end portion, the bellow fixedly coupled to the end portion in a coupling area, wherein the bellow is fixedly coupled to the axial end of the valve needle, and the end portion of the bellow arrangement is fixedly coupled to the end portion of the valve body, and wherein the bellow arrangement is sealingly coupling the valve body with the valve needle, the coupling area having a second outer diameter, with the first outer diameter being equal to the second outer diameter.

2. The valve assembly of claim 1, wherein the cartridge is provided for receiving the valve needle.

3. The valve assembly of claim 1, wherein the coil of the actuator unit is arranged inside the housing.

4. The valve assembly of claim 3, wherein the housing is partially arranged around the valve cartridge.

5. An Injection valve comprising:

a valve body including a central longitudinal axis, the valve body comprising:

a cavity with a fluid inlet portion and a fluid outlet portion, an end portion arranged at an axial end facing away from the fluid outlet portion, a seat arranged at an axial end of the valve body facing the fluid outlet portion, and a valve cartridge and a housing, a valve needle axially movable in the cavity, the valve needle preventing a fluid flow through the fluid outlet portion in a closing position and releasing the fluid flow through the fluid outlet portion in further positions, the valve needle comprising:

an axial needle end facing away from the fluid outlet portion and facing the end portion of the valve body, and a seat part resting on the seat of the valve body in the closing position, wherein a contact area between the seat part and the seat of the valve body has a first outer diameter, an electro-magnetic actuator unit configured to actuate the valve needle and comprising an armature and a coil, a ring element arranged in the cavity radially between the cartridge and the housing and axially between the coil and the armature, an armature support spring arranged in the cavity axially between the ring element and the armature, a bellow arrangement comprising a bellow and an end portion, the bellow fixedly coupled to the end portion in a coupling area, wherein the bellow is fixedly coupled to the axial end of the valve needle, and the end portion of the bellow arrangement is fixedly coupled to the end portion of the valve body, and wherein the bellow arrangement is sealingly coupling the valve body with the valve needle, the coupling having a second outer diameter, with the first outer diameter (D1) being equal to the second outer diameter.

* * * * *